US005092658A

United States Patent [19]

Smith

[11] Patent Number: 5,092,658

[45] Date of Patent: Mar. 3, 1992

[54] APPARATUS FOR SURFACE PROFILING

[75] Inventor: Ellis S. Smith, Franksville, Wis.

[73] Assignee: Surface Preparation Systems, Chicago, Ill.

[21] Appl. No.: 626,262

[22] Filed: Dec. 12, 1990

[51] Int. Cl.[5] ..... E01C 23/08

[52] U.S. Cl. ..... 299/39; 51/176; 299/88; 404/90

[58] Field of Search ..... 299/39, 87, 88, 89; 404/90; 51/176

[56] References Cited

U.S. PATENT DOCUMENTS

| | | | |
|---|---|---|---|
| 4,333,686 | 6/1982 | Arnswald | 51/176 X |
| 4,704,045 | 11/1987 | Taylor et al. | 299/39 X |
| 4,891,858 | 1/1990 | Wachter | 51/176 X |

*Primary Examiner*—David J. Bagnell

*Attorney, Agent, or Firm*—Tilton, Fallon, Lungmus & Chestnut

[57] ABSTRACT

Apparatus for profiling surfaces which includes a drum rotatably mounted on a frame, the drum having a plurality of generally helically extending grooves with a plurality of clip elements in each groove, at least one hardened bit member mounted in each clip element and extending radially outwardly of the periphery of the drum.

12 Claims, 2 Drawing Sheets

Fig. 2
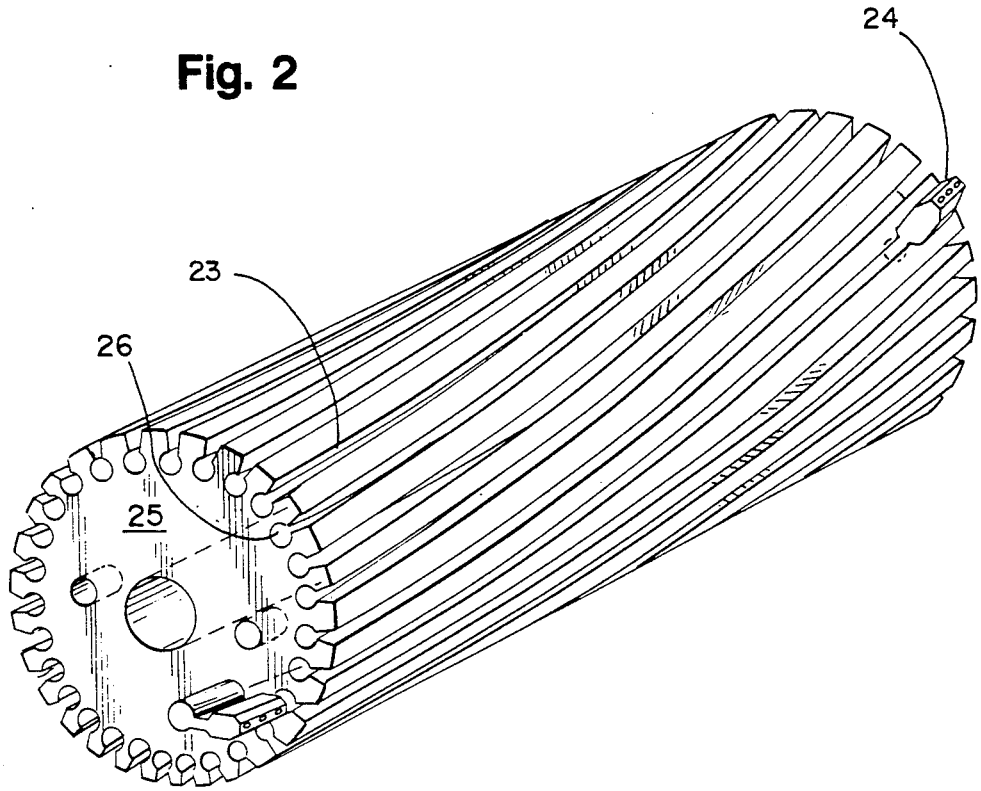
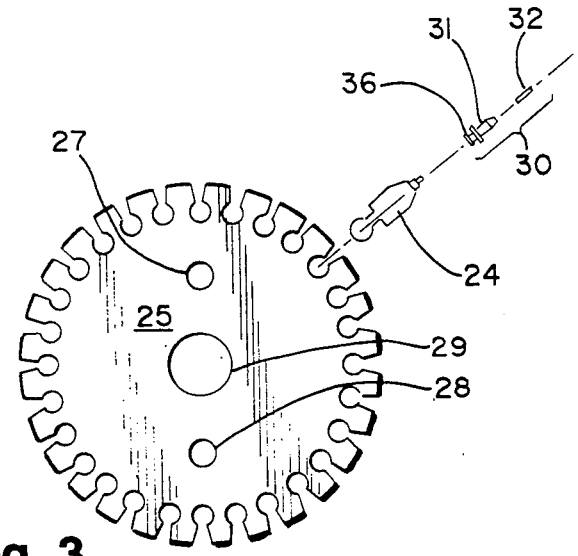
Fig. 3
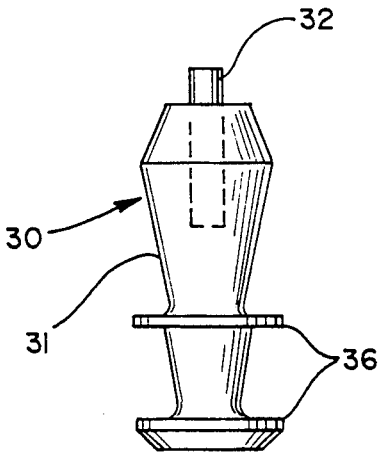
Fig. 4

APPARATUS FOR SURFACE PROFILING

BACKGROUND AND SUMMARY OF INVENTION:

This invention relates to apparatus for surface profiling and, more particularly for stripping for material from concrete or like surfaces for revitalization.

Preparing surfaces such as concrete for resurfacing has always been a costly, time consuming and dirty job. This is particularly true when the concrete surface has been covered with a protective coating such as an elastomeric membrane, sealant, paint, aircraft tire rubber, etc. Shot blasting has not always been effective in removing such membranes because the shot often is unable to penetrate adequately and grinding generates so much heat that coatings gum-up making removal difficult.

According to the invention, the drawbacks of the prior art are overcome through the use of a rotatable drum having generally helical extending grooves in the periphery, a plurality of clip elements constructed of elastomeric material mounted in side-by-side relation in each groove and with each clip element having a protruding hardened bit.

The invention offers uses a faster, cleaner, quieter and safer alternative to conventional methods of concrete cleaning, membrane removal, laitance removal and surface profiling. In particular, the unique drum-clip-bit arrangement makes the apparatus quiet enough for night-time use in connection with parking garages, highways, runways and on steel surfaces (aircraft carrier flight decks), asphalt (painted lane marking stripes), etc.

Other objects and advantages of the invention may be seen in the details of the ensuing specification.

BRIEF DESCRIPTION OF DRAWING

The invention is described in conjunction with the accompanying drawing, in which:

FIG. 2 is a perspective view of one section of the drum means employed in the practice of the invention and with one clip element installed and another in a position to be slid into one of the generally helically extending grooves in the hub section of the drum means;

FIG. 3 is an enlarged end elevational view of one hub section and showing the bit member of the invention in exploded form; and FIG. 4 is a side elevational view of the bit member constructed according to the invention.

DETAILED DESCRIPTION

Figure 1:
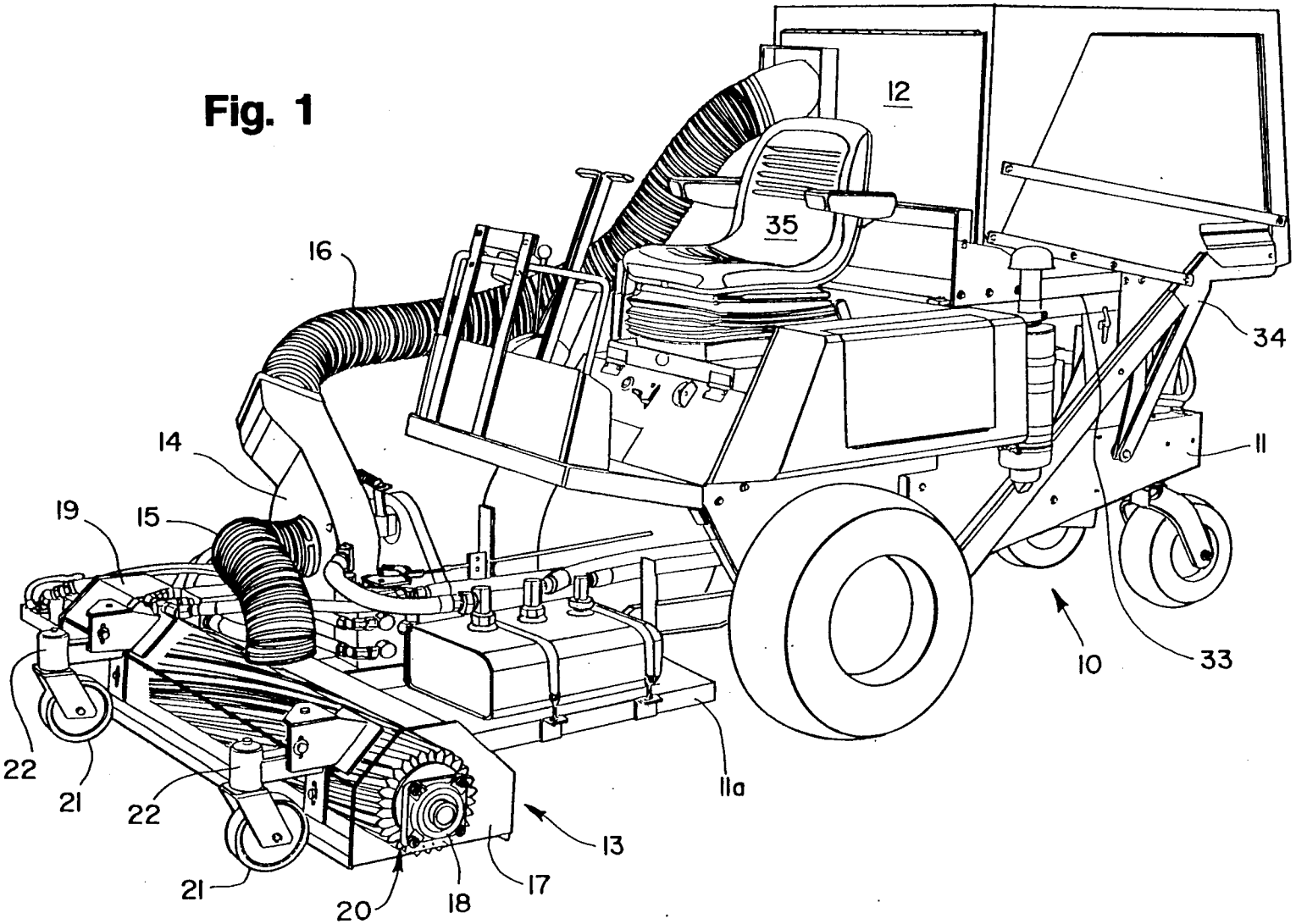
FIG. 1 is a perspective view of the inventive apparatus provided as part of the self propelled vehicle.

In the illustration given, the numeral 10 designates generally a self-propelled vehicle which is advantageously employed in the practice of the invention. The numeral 11 designates the chassis of the vehicle 10 and the numeral 12 designates a hopper or storage means for receiving the fragments or debris from a stripping or profiling operation.

The numeral 13 designates generally the stripper sub-assembly which is provided on a frame 11*a* provided as part of the chassis 11. The numeral 14 designates a blower mounted on the frame 11*a* with the numeral 15 designating a suction hose and 16 a pressure hose coupling the blower 14 to the hopper 12.

The numeral 17 designates a hood for the stripper means which is mounted on the frame 11*a* and connected by suction hose 15 to the inlet of the blower 14.

The numeral 18 designates end bearings provided in the hood or housing 17. The numeral 19 designates a drive motor on the frame 11*a* for the drum generally designated 20 and which is carried in the end bearings 18.

Provided on the frame 11*a* are adjustable casters 21 which provide both guide means for the frame and control of the depth of penetration of the drum 20. The numeral 22 designates the depth control assembly for moving the casters up and down so as to position the periphery of the drum relative to the surface being profiled.

Turning now to FIG. 2, a section of the drum 20 is depicted. In the illustration given, four hub sections are provided in axially aligned, connected relation with each hub section being one foot long, thereby providing an overall assembly of four feet in axial length.

Each hub assembly is equipped with a plurality of generally helically extending grooves 23 and mounted in each groove are a plurality of clip elements 24. Thus, if the clip elements (which provide the stripping function) are omitted from one or more of the hub sections 25, halves of different cutting width can be provided, viz., one foot, two foot, three foot, etc.

Each groove 23 is undercut or enlarged at a point radially inwardly as at 26 and the inner end of the clip element 24 is similarily contoured.

Referring now to FIG. 3, an end view of one hub section 25 is depicted and provided in each hub section are mating pin bores 27, 28 for the axial alignment and connection of the different hub sections. Also provided in each hub is a shaft bore 29 for the receipt of a shaft carried by the end bearings 18 and rotated by the motor 19.

Still referring to FIG. 3, the numeral 30 designates generally the bit member of the invention which is seen to include a steel body 31 of generally cylindrical configuration and a tungsten carbide tip 32 protruding generally radially therefrom.

More particularly, the tungsten carbide tips are formed from tungsten carbide steel rods which are embedded in the steel bases 31. The bases or bodies 31 have been machined to provide requisite flexibility and serve as an anchor when molded into the plastic clip element 24. Each clip element 24 is an injection molded urethane element which are slid into the helically extending grooves 23 of a plastic cylinder hub segment. The hubs 25 are machined each from a solid cylinder of UHMW nylon and grooves are cut helically along the access of each hub segment.

Operation

In use, the drum 20 is equipped with clips 24 over the desired axial length corresponding to the width of the path to be stripped. Thereafter, the caster height adjusting means 22 are adjusted to the depth of the cut which is generally in the range of 0–¼" deep.

Thereafter the vehicle 10 whose chassis 11 carries an engine or motor means 33 is advanced while the drum 20 is rotated by the motor 19 and the blower 14 operates to draw debris from the hood 17 and deliver the same to the hopper 12. At the completion of the job or filling of the hopper 12, whichever occurs first, the hopper 12 is raised by hydraulic means 34 for dumping into a truck or trailer.

The chassis 11 is equipped with the operator's seat 35 which is mounted over the pivot point of the vehicle 10 so that turning stress on the operator is eliminated resulting in lower operator fatigue and providing higher productivity. The compact nature of the vehicle 10 equipped with the stripper 13 provides superior maneuverability to work in tight places like factories and parking garages. The motor 19 is bi-directional so that the drum 20 can be rotated in either direction and the unit therefore being operational in the reverse direction as well.

The vacuum system consisting of the elements 14–16 leaves the surface being profiled in a clean and dry state and keeps dust to a minimum.

The use of the carbide cutting tips 32 provide hours of service and the entire drum 20 can be changed quickly to keep the apparatus up and running.

In the illustrated embodiment, the angular displacement of each generally helical groove 23 relative to an axially extending line on the periphery of the drum 20 is about 90° over four feet of axial drum length. As mentioned previously, each groove is enlarged radially inwardly of the periphery of the drum 20 to provide an undercut 26 for mounting a similarly contoured clip element 24. The clip elements 24 extend into the undercut to provide a resilient mounting for the bit members 30 to avoid aggregate fracture and the like while still stripping any associated burden or membrane material.

As mentioned previously, each bit member includes a generally cylindrical metal body 31 about ¾" long and having a tungsten carbide tip 32 partially embedded therein and protruding generally radially outwardly therefrom about 1/16". Each metal body 31 is relatively elongated and adjacent the inner end thereof equipped with longitudinally spaced flange means as at 36 to facilitate heat dissipation. Also, the bit members are provided in longitudinally spaced relation in the grooves again to afford ready heat dissipation therefrom. In the illustration given, each clip element 24 is equipped with three bit members 30 although a greater or lesser number may be employed as indicated by the character of the apparatus and the environment of use.

While in the foregoing specification a detailed description of an embodiment of the invention has been set down for the purpose of illustration, many variations in the details hereingiven may be made by those skilled in the art without departing from the spirit and scope of the invention.

I claim:

1. Apparatus for profiling surfaces comprising a frame, drum means rotatably mounted on said frame, means operably associated with said frame for rotating said drum, a plurality of generally helically extending grooves in the periphery of said drum means, a plurality of clip elements in each groove in side-by-side relation, each clip being constructed of thermosetting material, and at least one hardened bit member mounted in each clip element and extending generally radially outwardly of the periphery of said drum means.

2. The apparatus of claim 1 in which said frame is part of the chassis of a wheeled vehicle, a hood for said drum means mounted on said frame, a hopper on said chassis and air flow means connecting said hood and hopper for transporting debris stripped from a surface from said hood to said hopper.

3. The apparatus of claim 2 in which said chassis is equipped with motor means for propelling said vehicle, said frame projecting forwardly from said chassis and an operator's seat on said chassis.

4. The apparatus of claim 3 in which said frame is equipped with adjustable caster means for supporting said drum means at different distances relative to a surface being profiled.

5. The apparatus of claim 2 in which chassis is equipped with means for raising said hopper for dumping the same.

6. The apparatus of claim 1 in which said drum means includes a plurality of hubs connected together in axial, side-by-side relation.

7. The apparatus of claim 6 in which the angular displacement of each generally helical groove relative to an axially-extending line on the periphery of said drum is about 90° over four feet of axial length.

8. The apparatus of claim 1 in which each groove is enlarged radially inwardly of the periphery of said drum means to provide an undercut for mounting a similarily contoured clip element, said clip elements extending into said undercut to provide a resilient mounting for said bit members to avoid aggregate fracture and the like while still stripping any associated burden or membrane material.

9. The apparatus of claim 1 in which each bit member includes a generally cylindrical metal body having a tungsten carbide tip partially embedded therein and protruding generally radially outwardly therefrom.

10. The apparatus of claim 9 in which said metal body is relatively elongated and adjacent the inner end being equipped with longitudinally spaced flange means.

11. The apparatus of claim 1 in which said bit members are spaced apart in said grooves to afford heat dissipation therebetween.

12. The apparatus of claim 1 in which each clip element is equipped with a plurality of bit members spaced longitudinally of said grooves.

* * * * *